United States Patent [19]

Kliewer

[11] Patent Number: 4,759,384

[45] Date of Patent: Jul. 26, 1988

[54] APPARATUS FOR SPIN-CLEANING SLENDER PAINT BRUSHES

[76] Inventor: Peter A. Kliewer, 691 Candlestick Rd., Nashville, Tenn. 37211

[21] Appl. No.: 57,590

[22] Filed: Jun. 2, 1987

[51] Int. Cl.[4] ..... B08B 3/04

[52] U.S. Cl. ..... 134/140; 134/157; 15/38; 269/131; 269/902

[58] Field of Search ..... 134/140, 147, 149, 157, 134/162; 269/130, 131, 108, 254 R, 902; 15/38

[56] References Cited

U.S. PATENT DOCUMENTS

| | | | |
|---|---|---|---|
| 1,672,808 | 6/1928 | Hansel | 269/902 X |
| 1,816,723 | 7/1931 | Dunoyer | 269/131 |
| 2,519,259 | 8/1950 | Liebman | 15/38 X |
| 2,873,463 | 2/1959 | Nunes | 134/157 X |
| 2,949,921 | 8/1960 | Boland | 134/162 X |
| 3,252,174 | 5/1966 | Schoepske | 15/38 X |
| 3,758,101 | 9/1973 | Sewell | 269/254 R |

*Primary Examiner*—Harvey C. Hornsby
*Assistant Examiner*—Stephen F. Gerrity
*Attorney, Agent, or Firm*—Harrington A. Lackey

[57] ABSTRACT

A slender paint brush holder for attachment to a rotary drive member, such as an electric power drill for rotating an elongated, slender paint brush about an axis perpendicular to the elongated handle of the brush, in order to spin-clean the brush. The holder includes a pair of longitudinally spaced, aligned V-shaped recesses for receiving the handle of the brush, a spindle for reception within the chuck of the power driven drive member, and a transverse notch for receiving an elastic binder member fastened to the holder and across the brush handle.

3 Claims, 1 Drawing Sheet

APPARATUS FOR SPIN-CLEANING SLENDER PAINT BRUSHES

BACKGROUND OF THE INVENTION

This invention relates to an apparatus for spin-cleaning slender paint brushes, and more particularly to an attachment for a rotary power-driven tool for spin-cleaning an elongated, slender paint brush perpendicular to its rotary axis. Heretofore, artist's paint brushes and stencil brushes, hereinafter referred to as slender paint brushes, as opposed to larger house paint brushes, have been cleaned manually. When the artist is through painting with his brush, the brush is dipped or soaked in a brush cleaning solvent. After a period of time, the brush is removed and the paint residue worked out by any conventional methods, such as by combing, then the brush is allowed to dry. When sufficient paint residue is not removed, the process may be repeated.

Spin-cleaning of large house paint brushes by the use of rotary power equipment for rotating the paint brushes to remove paint and to dry the brushes by centrifugal force is also known, as shown the following patents:

| | | |
|---|---|---|
| 2,519,259 | Liebman | Aug. 15, 1950 |
| 2,832,156 | Johnson | Apr. 29, 1958 |
| 2,873,463 | Nunes | Feb. 17, 1959 |
| 2,931,661 | Harris | Apr. 5, 1960 |
| 3,252,174 | Schoepske, Jr. | May 24, 1966 |
| 3,399,463 | Stott | Sep. 3, 1968 |

German Patent No. 2,022,788 Nov. 25, 1971

The Liebman patent discloses a brush cleaning apparatus for a plurality of paint brushes circumferentially spaced and radially mounted about a rotary shaft.

Nunes, Harris, Stott, and the German patent, each discloses a single paint brush supported upon a power-driven tool for rotary movement about an axis coincidental with the longitudinal axis of the paint brush or handle.

Johnson and Schoepske, Jr. disclose an individual paint brush supported for rotary movement about an axis perpendicular to the paint brush handle and secured to a drive member, such as an electric motor or power drill. The Johnson patent discloses an encompassing and adjustable clamp member for gripping the head of a house paint brush for support for rotary movement, while the Schoepske, Jr. patent discloses a drive spindle fitting into a hole formed in the handle of the paint brush.

The following U.S. patents disclose various types of tool holders including a V-shaped notch or recess for receiving an elongated portion of a tool and a cooperating clamp member for holding the tool in the V-shaped recess:

| | | |
|---|---|---|
| 1,615,488 | Schleicher | Jan. 25, 1927 |
| 1,816,723 | Dunoyer | July 28, 1931 |
| 2,472,040 | Brookfield | May 31, 1949 |

The Schleicher and Dunoyer patents disclose an elongated tool clamped in a V-shaped recess by a flexible looped member. FIGS. 2 and 2*a* of Dunoyer disclose an elongated, cylindrical object supported in a V-shaped recess by a flexible ribbon, with slot means for receiving the ribbon. both Schleicher and Dunoyer are provided with tensioning means for tensioning one end of the flexible clamping member.

All of the above patents, Schleicher, Dunoyer and Brookfield are designed for supporting a tool in a stationary position, and are not designed for rapid rotation about an elongated rotary axis, much less provided with means for attachment to a rotary drive member such as the chuck of a power drill.

SUMMARY OF THE INVENTION

It is therefore an object of this invention to provide an apparatus for attachment to a rotary drive member, such as an electric power drill, for supporting an elongated, slender paint brush, of the type used by artists, for spin-cleaning the brush.

The apparatus for spin-cleaning a slender paint brush includes a holder body provided with a pair of elongated and identical V-shaped recesses for receiving the middle portion, generally of uniform cross-section, of the slender paint brush. A transverse notch is formed in the holder between the V-shaped recesses in order to receive an elastic binder member, such as an elastic band, engaging the exposed surface of the paint brush and fastened to the holder, such as by pins about which the elastic band member is secured. Projecting from the opposite or back surface of the holder from the open V-shaped recesses is an elongated spindle, which is adapted to be received coaxially within the chuck of a conventional electric power drill. The V-shaped recesses and the mass of the holder are symmetrically formed about the rotary axis of the spindle. Moreover, when the slender brush is placed in operative position longitudinally within and against the V-shaped recesses, the brush is positioned so that the center of mass, or center of gravity, of the brush is as close to the rotary axis as possible. Therefore the brush will be balanced during its rapid rotation.

After the brush is secured upon the holder by the elastic binder member and the holder is inserted within the chuck of the power drill, the brush is inserted within any type of cylindrical container whose diameter is greater than the length of the brush. The electric motor of the drill is started to rapidly spin the brush so that any paint and/or cleaner is forced radially outward by centrifugal force. After the brush has been cleaned from paint, the brush may be rinsed in a solvent and then spin-dried.

The apparatus made in accordance with this invention is adapted to receive and spin-clean and/or spin-dry slender paint brushes of varying diameters and sizes.

DESCRIPTION OF THE PREFERRED EMBODIMENTS

Figure 1:
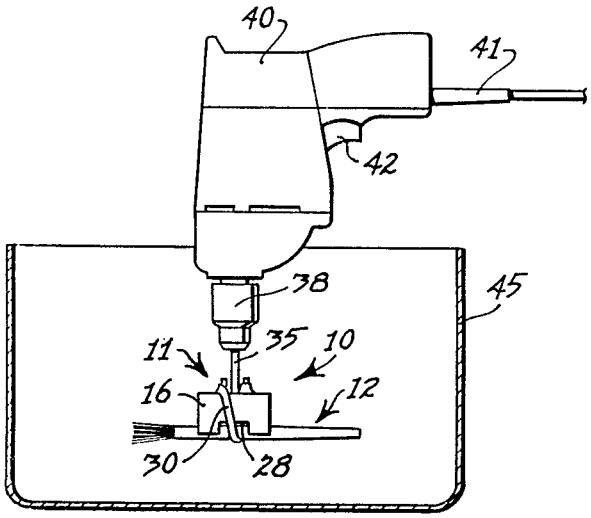
FIG. 1 is a side elevation of the holder made in accordance with this invention, carrying a slender paint brush which is secured to an electric power drill for spin-leaning within a container.

Referring now to the drawings in more detail, the apparatus 10 made in accordance with this invention includes a holder 11 for an elongated, slender paint brush 12, such as an artist's paint brush or stencil brush.

Figure 3:
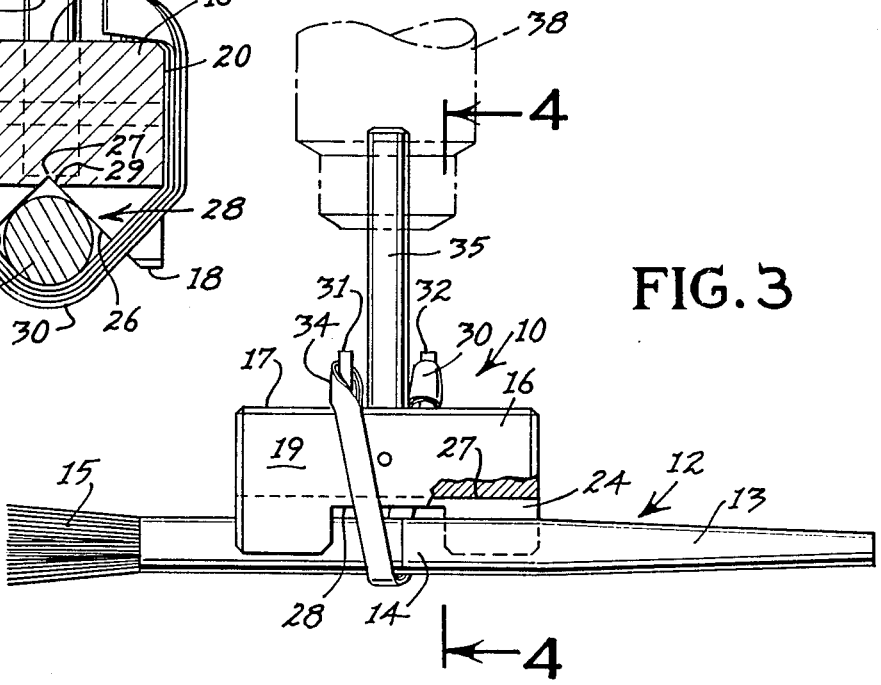
FIG. 3 is an enlarged side elevational view of the holder, with portions broken away, upon which the brush has been mounted, and illustrating the drill chuck in phantom, assembled upon the spindle of the holder.

The slender paint brush 12 adapted to be received in the holder 11 is an elongated brush having an elongated handle member 13 with a middle portion 14 generally of uniform diameter and a brush head or bristles 15 at one end of the handle member 13, as best disclosed in FIG. 3. The slender paint brush 12 may be of different lengths and diameters, but should be distinguished from the larger house paint brushes having slender handles and enlarged brush heads.

The brush holder 11 includes an elongated holder body 16 having a back surface 17 and a face or face surface 18. The body 16 also has a pair of sides or side surfaces 19 and 20 and ends or end portions 21 and 22, as best disclosed in FIG. 2.

Formed in the face 18 of the holder 16 are a pair of longitudinally spaced V-shaped recesses 23 and 24. The recesses 23 and 24 are identical or substantially identical in shape and angle and are in longitudinal alignment at opposite ends of the holder 16. Moreover, the V-shaped recesses 23 and 24 open outward through the face 18 of the holder 16.

Figure 4:
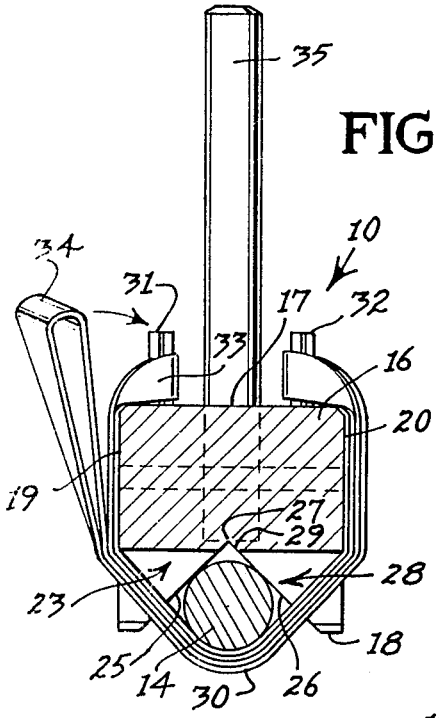
FIG. 4 is an enlarged sectional elevation taken along the line 4—4 of FIG. 3, and illustrating the securing of the paint brush within the holder by the elastic binder member.

As best disclosed in FIG. 4, each of the recesses 23 and 24 includes a pair of planar side surfaces or walls 25 and 26 which converge to a common vertex line 27 extending longitudinally through the holder 16 and parallel to the longitudinal axis of the elongated holder 16.

The V-shaped recesses 23 and 24 are of equal length and equally spaced about the center of the brush holder 16.

Also formed in the face 18 and occupying the spacing between the two V-shaped recesses 23 and 24 is a transverse slot 28 extending entirely transversely through the central portion of the holder 16 and through the opposite side surfaces 19 and 20, without obstruction.

The depth of the transverse slot 28 is preferably substantially the same as the depth of each of the V-shaped recesses 23 and 24. As disclosed in the drawings, the depth of the transverse slot 28 is slightly less than the depth of the recesses 23 and 24, since the transverse slot 28 includes an elongated depression or groove 29 which is coincidental with the bottom portions of the V-shaped recesses 23 and 24.

The size of the V-shaped recesses 23 and 24 are such that they will readily receive the elongated slender paint brush 12 with the middle portion 14 engaging the opposed side walls 25 and 26 of the respective recesses 23 and 24. The brush 12 is manually positioned within the holder 16 so that the center of gravity of the brush 12 is substantially in the center of the holder 16.

In order to hold the brush 12 within the V-shaped recesses 23 and 24, an elongated elastic binder member 30 having a length substantially greater than the length of the transverse slot 28 is provided.

The particular elastic binder member 30 disclosed in the drawing is an elongated, endless elastic band, such as a rubber band. The band member 30 is adapted to extend transversely over the mid-portion 14 of the brush 12 with its opposite end portions fastened to the holder 16 in order to hold the brush 12 within the holder 16. As disclosed in the drawings, the endless band member 30 is held in its binding operative position by utilizing its looped end portions.

Figure 2:
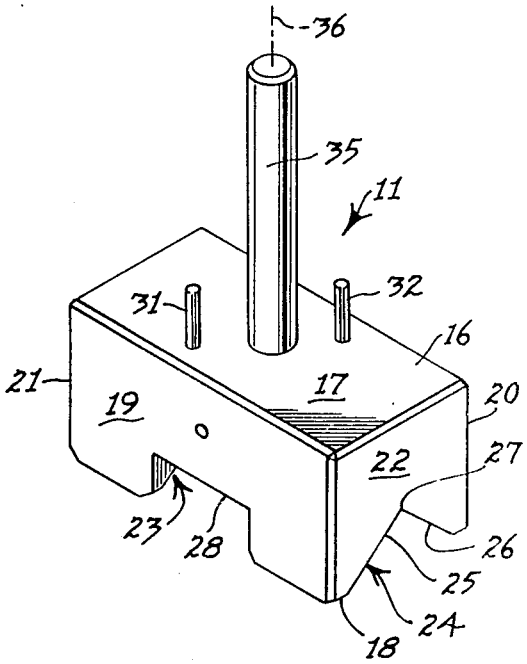
FIG. 2 is an enlarged bottom perspective view of the paint brush holder disclosed in FIG. 1.

As best disclosed in FIG. 2, a pair of fastener pins 31 and 32 are fixed to and project outward from the back surface 17, preferably in a balanced position. As best disclosed in FIGS. 3 and 4, one looped end 33 of the binder member 30 is placed over one of the pins 31. The elastic binder member is then wrapped around the mid-portion 14 of the handle member 13 extending through the transverse slot 28 and around the opposite side, where the entire band member 30 is wrapped around the second fastener pin 32. The band member 30 is then brought back around the side 20, across the mid-portion 14 and back across the side wall 19, terminating in its opposite looped end 34. In FIG. 4, the looped end 34 is shown just before it is looped over the same fastener pin 31 in order to secure the binder member 30 about the paint brush 12.

It will be understood that a binder member 30 half as long as that disclosed in the drawings could be utilized so that its opposite looped ends will fit over the respective astener pins 31 and 32, and the binder member 30 will extend once across the handle member 12. However, the binder member 30 disclosed in the drawings is long enough to wrap twice across the handle member 13 in order to afford additional security.

Projecting outward from the back surface 17 in the center of the holder body 16 is an elongated spindle 35 having an elongated rotary axis 36. The spindle 35 is precisely fixed to the back surface 17 so that the rotary axis 36 will intersect the elongated common vertex line 27 forming the bottom of the V-shaped recesses 23 and 24. Moreover, the rotary axis 36 is spaced equidistant between the end surfaces 21 and 22 to provide perfect balance for the holder 11 when it is rotated.

The spindle 35 is designed to be received in a socket or chuck 38 of a rotary power driven tool, such as the electric power drill 40 disclosed in FIG. 1. The power drill 40 may be connected through an electrical cord 41 to a source of electrical power not shown, and actuated by the trigger 42.

In the operation of the apparatus 10 for cleaning and drying a slender paint brush 12, the spindle 35 is first inserted into the socket or chuck 38 and the chuck tightened to securely hold the brush holder 11 for rotary movement when the drill 40 is actuated. The brush 12 which has been used in painting is first manually worked to remove the excess paint from the bristles 15, such as by wiping the brush 15 back and forth upon an old newspaper. The brush 12 may be further worked after applying an appropriate thinner or solvent to the bristles 15. The brush 12 is then placed longitudinally within the pair of V-shaped recesses 23 and 24 with the estimated center of mass or gravity located in alignment with the rotary axis 36 of the spindle 35. The operator or artist then holds the brush 12 in its centered position with the middle portion 14 engaging the side walls or surfaces 25 and 26 of the corresponding V-shaped recesses 23 and 24 while one end 33 of the elastic binder member 30 is looped around either of the pins, such as the pin 31. The elastic binder member 30 is then stretched and pulled across the middle portion 14 of the handle 13 through the transverse slot 28 until the middle portion of the binder member extends back to the back surface 17. The middle portion of the binder member 30 is then wrapped around the other fastener pin 32 and the remainder of the fastener member is then brought back around the holder 16, across the middle handle portion 14, and then the other looped end 34 of the fastener member is passed over the same fastener pin 31, as illustrated in FIG. 4.

With the slender brush 12 secure in its balanced position on the holder 11, which in turn is secured within the chuck 38 of the power drill 40, the operator then grasps the handle of the drill 40 and lowers the holder 11 with its secured paint brush 12 into a large container 45, preferably a cylindrical container, such as a can, bucket or tub having a diameter greater than the length of the brush 12, as illustrated in FIG. 1. With the brush 12, holder 11 and drill 40 in the position disclosed in FIG. 1 within the container 45, the trigger 42 is pulled to energize the drill 40 and commence the rotation of the spindle 35, holder 11 and the brush 12.

As the rotary speed of the spindle 35 and hence the brush 12 increases, the residual paint and solvent in the bristles 15 moves radially outward by centrifugal force until it is discharged against the inner walls of the container 45.

In a preferred form of the invention, the drill 40 should be reversible, so that the rotation of the brush 12 may be alternately reversed. Also preferably, the drill should have variable speeds of at least 1,200 rpm, but not greater than 2,000 rpm.

When heavier brushes 12, or brushes having handles longer than 12 inches, are cleaned, the speed of rotation should be reduced.

When the brush 12 is alternately rotated, it is rotated in each rotary direction for approximately five seconds.

After the spin-cleaning process is completed, that is when it is believed that all of the paint residue which is possible to be removed has been removed, the drill 40 is de-energized until the brush 12 stops. Then a thinner or solvent is again applied to the bristles 15 and the brush inserted into the container 45 and the drill 40 re-energized to repeat the spinning process. This last spinning process will tend to eliminate any additional paint residue and also to dry the brush 12. The rapidly moving brush 12 will create sufficient turbulence to air-dry the brush head or bristles 15.

It will be apparent from the above description that a brush holder 11 has been provided which can be easily mounted into the existing chuck 38 of a conventional electric power drill 40, and which will adequately support an elongated, slender paint brush 12, such as an artist's paint brush or a stencil brush, and which will afford a substantially improved method of cleaning and drying this type of paint brush.

What is claimed is:

1. An apparatus for attachment to a rotary drive member for spin-cleaning a slender paint brush, including an elongated handle member having a brush at one end and a middle portion of generaly uniform cross-section, comprising:

(a) an elongated holder body having a face surface, an opposed back surface, opposed sides, opposed end portions, and a longitudinal axis, (b) a pair of longitudinally spaced V-shaped recesses formed in said face surface and longitudinally aligned with each other and said longitudinal axis, (c) said V-shaped recesses opening outward through said face surface and having corresponding coplanar walls which intersect along a common vertex line parallel to said longitudinal axis, (d) a transverse slot formed transversely through said face surface and said opposite sides and occupying the spacing between said V-shaped recesses, the depth of said transverse slot being substantially as great as the depth of said V-shaped recesses, (e) said V-shaped recesses being adapted to receive the middle portion of an elongated slender paint brush in longitudinal alignment with said V-shaped recesses in an operative position, (f) an elongated, flexible, elastic, endless band having opposite looped end portions, said band being long enough to extend transversely across the middle portion of a slender paint brush in said transverse slot, when said paint brush is received in said V-shaped recesses in said operative position, (g) an elongated spindle projecting from said back surface, said spindle having an elongaed rotary axis perpendicular to said vertex line and being adapted to be rotatably driven by a rotary drive member, (h) a pair of fastener pins fixed to and projecting outward from said back surface parallel to and in a balanced position relative to said spindle, and (i) said looped end portions of said elastic band being adapted to be looped around any of said fastener pins when said elastic band is extended across said slender paint brush in said operative position to retain said slender paint brush in said V-shaped recesses when said holder body is rotated about said rotary axis.

2. The invention according to claim 1 further comprising a rotary drive member having a rotary chuck, said chuck being adapted to coaxially receive said spindle, and means for driving said drive member.

3. The invention according to claim 1 in which said walls of said V-shaped recesses are symmetrical about a plane containing said vertex line and the rotary axis of said spindle.

* * * * *